US008813279B2

(12) United States Patent
Saunders et al.

(10) Patent No.: US 8,813,279 B2
(45) Date of Patent: Aug. 26, 2014

(54) MATTRESSES AND MATTRESS FOUNDATIONS

(71) Applicant: Dreamwell, Ltd., Las Vegas, NV (US)

(72) Inventors: Craig Saunders, Rocky River, OH (US); J. Evan Spirk, Gates Mills, OH (US); Lindsey Tufts, Cleveland, OH (US); Alex Velet, Cleveland, OH (US); Steve Hughett, Cleveland, OH (US)

(73) Assignee: Dreamwell, Ltd., Las Vegas, NV (US)

( * ) Notice: Subject to any disclaimer, the term of this patent is extended or adjusted under 35 U.S.C. 154(b) by 28 days.

(21) Appl. No.: 13/649,441

(22) Filed: Oct. 11, 2012

(65) Prior Publication Data

US 2013/0086743 A1 Apr. 11, 2013

Related U.S. Application Data

(60) Provisional application No. 61/545,795, filed on Oct. 11, 2011.

(51) Int. Cl.
*A47C 19/00* (2006.01)

(52) U.S. Cl.
USPC ..... 5/400; 5/200.1; 5/716

(58) Field of Classification Search
CPC .... A47C 19/00; A47C 27/085; A47C 19/021; A47C 27/05; A47C 27/001; A47C 27/062; A47C 15/008; A47C 17/00; A47C 27/00
USPC ..... 5/400, 401, 137–144, 200.1, 230–234, 5/716; 482/27–29
See application file for complete search history.

(56) References Cited

U.S. PATENT DOCUMENTS

| | | | | | |
|---|---|---|---|---|---|
| 134,430 | A * | 12/1872 | Hawk | 5/232 |
| 464,604 | A * | 12/1891 | Hunt | 5/231 |
| 537,847 | A * | 4/1895 | Osborne | 5/188 |
| 763,442 | A * | 6/1904 | Van Cise | 5/200.1 |
| 795,223 | A * | 7/1905 | Hervey | 5/244 |
| 3,119,126 | A * | 1/1964 | Goodman | 5/230 |
| 4,112,529 | A * | 9/1978 | Golembeck et al. | 5/401 |
| 4,567,615 | A * | 2/1986 | Fanti | 5/191 |
| 4,703,526 | A * | 11/1987 | Degen | 5/237 |
| 5,924,149 | A * | 7/1999 | Weber | 5/238 |
| 6,584,627 | B1 * | 7/2003 | Yang | 5/191 |
| 7,003,822 | B1 | 2/2006 | Sheehy | |
| 7,832,040 | B2 | 11/2010 | Constantinescu et al. | |
| 8,191,186 | B2 * | 6/2012 | Lobry | 5/238 |
| 2002/0178498 | A1 * | 12/2002 | Baeriswyl | 5/200.1 |
| 2003/0131410 | A1 * | 7/2003 | Yang | 5/400 |

* cited by examiner

*Primary Examiner* — Nicholas Polito
*Assistant Examiner* — Myles Throop
(74) *Attorney, Agent, or Firm* — Cantor Colburn LLP

(57) ABSTRACT

Mattress and foundation assemblies generally include a mattress; and a mattress foundation for supporting the mattress, the mattress foundation including a frame configured to elevate the mattress relative to ground; and upper and lower flexible mesh suspension layers spaced apart from one another, each independently supported by a plurality of carriers at discrete points about the surface of the suspension layers, wherein the carriers are pivotably coupled to the frame.

22 Claims, 7 Drawing Sheets

MATTRESSES AND MATTRESS FOUNDATIONS

CROSS REFERENCE TO RELATED APPLICATIONS

This non-provisional application claims the benefit of U.S. Provisional Patent Application Ser. No. 61/545,795 filed on Oct. 11, 2011, which is fully incorporated herein by reference in its entirety.

BACKGROUND

The present disclosure generally relates to support foundations for mattresses, and more particularly, to mattress assemblies including dual supporting layers for independent suspension.

Standard mattress designs have evolved very little in the past fifty years. A standard mattress generally includes a set of metal springs or coils mounted either on a base under a pad, or sandwiched in the center of a pair of pads. The metal springs and pad or pads are then covered with a strapping material. The entire structure is then sewn into a cloth cover and the edges are wrapped and sewn. Thus, once the mattress is fabricated, the components are not replaceable. The limitations of metal spring mattresses combined with improved quality and durability of foam products has lead to the relatively recent development of a foam core mattress as a viable alternative to metal spring mattress. A foam core mattress can provide significant improvements in comfort and support compared to conventional spring-based mattresses. For example, spring-based mattresses inherently have varying properties over their surface, and the variations of properties relating to zone and surface areas are improved only with great difficulty.

A basic foam mattress may include one or more layers of foam having desirable properties assembled into a fabric cover so as to appear identical in appearance to a standard metal spring mattress. A foam mattress may include a center core of relatively high resilience foam sandwiched between two layers of lower resilience foam encased in a fabric shell. This construction allows for a reversible mattress.

Mattress foundations such as box springs have also evolved relatively slowly. Foundations are often typically constructed of a combination of materials, including wood, metal, and fiber and may include support sub-assemblies such as edge-reinforcing springs. Typically, conventional box springs include a wooden frame that supports an array of steel wire springs that elevate a grid or deck above the frame to provide a flexible support surface. The grid or deck can be formed of steel wire that is welded or clipped together. A cloth outer cover is typically disposed about the frame. The conventional box springs are generally large, heavy, and provide minimal flexibility.

One of the disadvantages with mattresses, especially foam mattresses, is the perceived temperature and firmness of the mattress.

BRIEF SUMMARY

The present disclosure is generally directed to mattress and foundation assemblies and mattress foundations that include dual suspension layers. In one embodiment, a mattress and foundation assembly, comprises a mattress; and a mattress foundation for supporting the mattress, the mattress foundation comprising a frame configured to elevate the mattress relative to ground; and upper and lower flexible mesh suspension layers spaced apart from one another, each independently supported by a plurality of carriers at discrete points about the surface of the suspension layers, wherein the carriers are pivotably coupled to the frame.

In one embodiment, a mattress foundation for supporting the mattress comprises a frame configured to elevate the mattress relative to ground; and upper and lower flexible mesh suspension layers spaced apart from one another, each independently supported by a plurality of carriers at discrete points about the surface of the suspension layers, wherein the carriers are pivotably coupled to the frame.

The disclosure may be understood more readily by reference to the following detailed description of the various features of the disclosure and the drawings included therein.

BRIEF DESCRIPTION OF THE SEVERAL VIEWS OF THE DRAWINGS

Referring now to the figures wherein the like elements are numbered alike.

DETAILED DESCRIPTION

Figure 1:
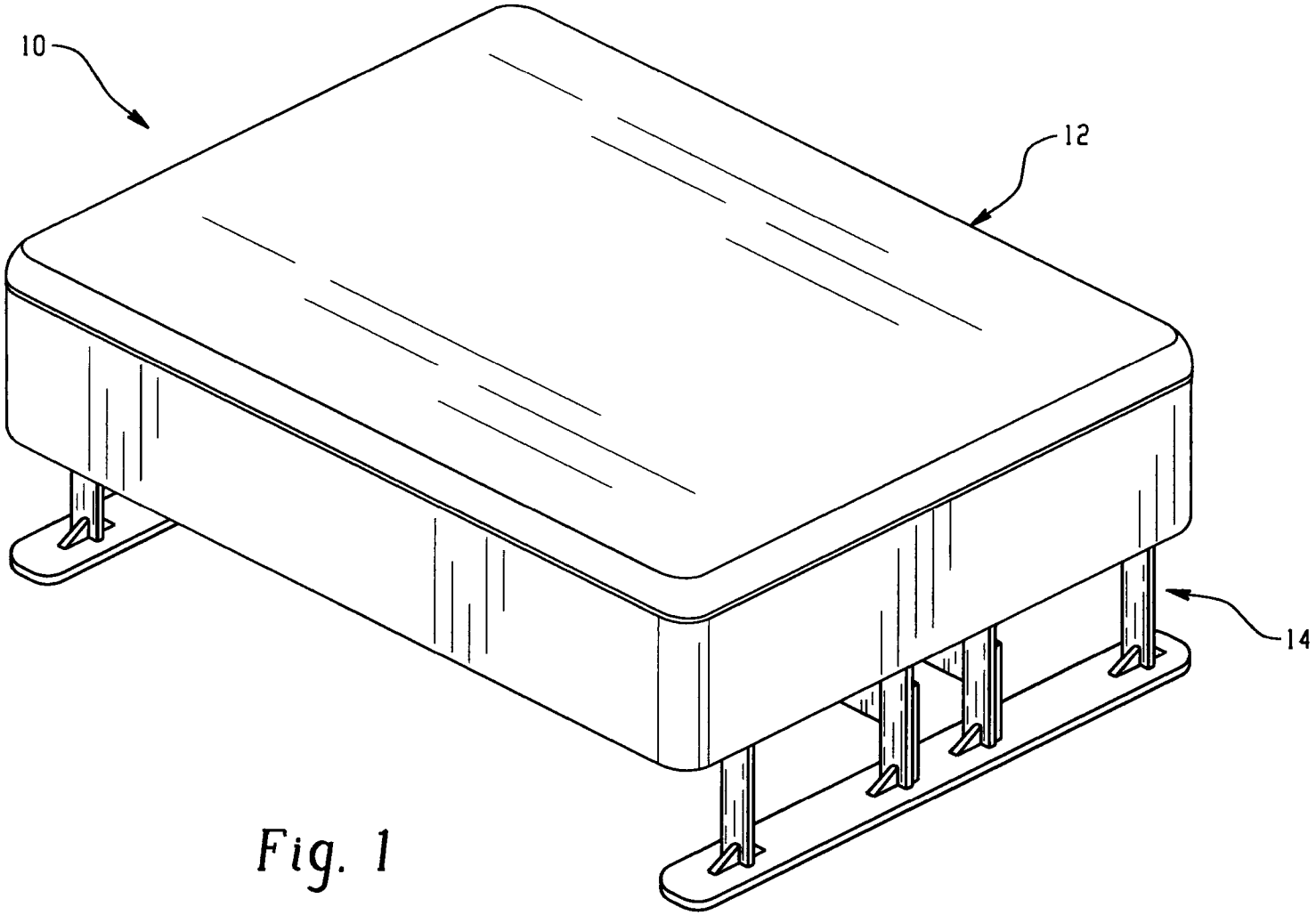
FIG. 1 is a perspective view of a mattress and foundation assembly in accordance with the present disclosure.
Figure 2:
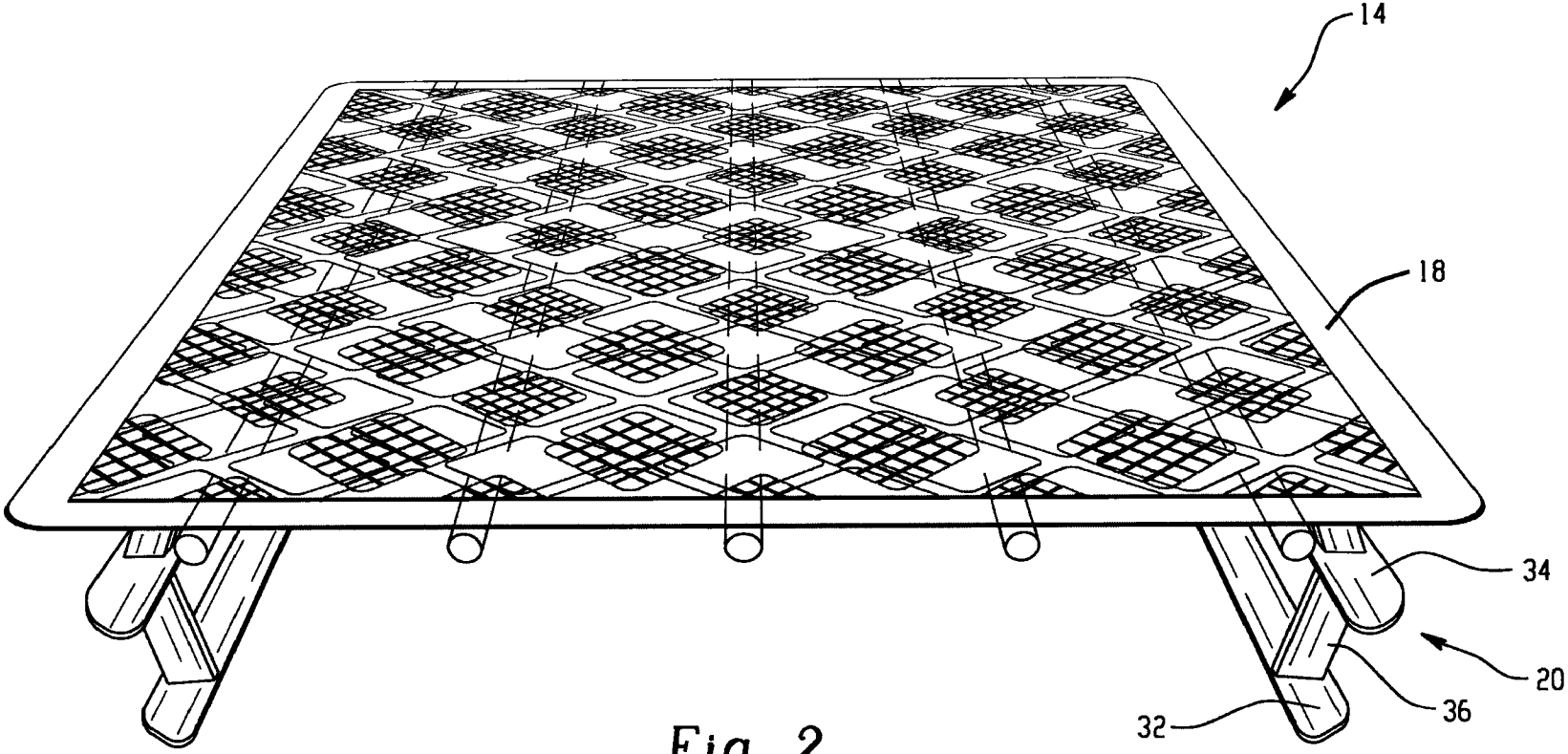
FIG. 2 is a perspective view of a mattress foundation in accordance with the present disclosure.
Figure 3:
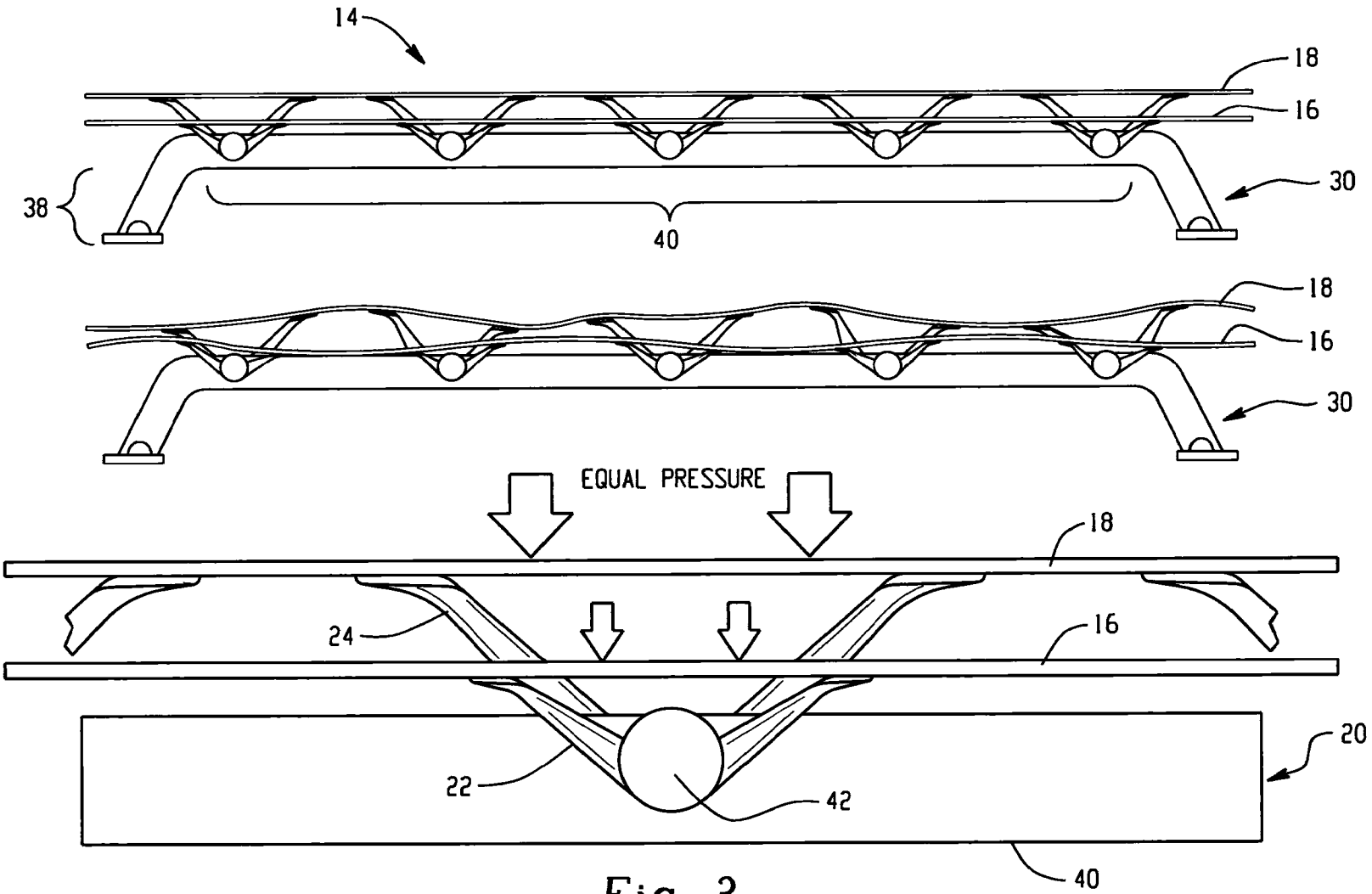
FIG. 3 provides side elevation views of the mattress foundation including the dual suspension layers with and without an applied load in accordance with the present disclosure.

Disclosed herein are mattress and foundation assemblies. Referring now to FIGS. 1-2, there are shown perspective views of a mattress and foundation assembly 10, in accordance with an embodiment of the present disclosure. The mattress and foundation assembly 10 generally includes a mattress 12 and a mattress foundation 14 including dual suspension layers. By utilizing dual suspension layers, both soft support and firm support can be provided. As will be discussed in greater detail below, the dual suspension layers conform to the user and reduce the various pressure points associated with the user while dissipating heat.

As shown more clearly in FIGS. 2-5, the mattress foundation 14 generally includes two spaced apart and rectangularly shaped mesh suspension layers 16, 18 that are flexible and independently supported by frame 20. The flexible mesh dual suspension layers 16, 18 are each supported at various contact points by numerous u-shaped carriers 22, 24, respectively, that are pivotably mounted to the frame 20 and define the relative height of each layer. U-shaped carriers 24 support the upper suspension layer 18 at a defined height and u-shaped carriers 22 support the lower suspension layer 16 at a defined height that is less than that of the upper suspension layer 18. In this manner, the u-shaped carriers 22, 24 can pivotably move and effect a local or global change in the relative position of one or both of the dual suspension layers 16, 18 in response to an applied force, e. g., the applied weight and/or pressure related to an individual and his movement on the mattress overlying the dual suspension layer. In the event that there is no applied pressure or the pressure is applied equally across a u-shaped carrier 22 and/or 24 of the mattress foundation assembly, the dual suspension layer(s) at that particular mattress location would generally not flex. It is only where there is uneven pressure across the u-shaped carrier(s) 22 and/or 24 that causes the u-shaped carrier to pivot about an axis defined by a rod supported by the frame 20 that upper suspension layer 18 or both the upper and lower suspension layers 18, 16, respectively, would exhibit flexure. The distance between the suspension layers 16, 18 is generally configured to be in an amount effective to provide flexure to both layers should a predefined load be applied unequally across a u-shaped carrier when in use. In some embodiments, it may be desired to provide greater flexure to the upper suspension layer 18 than the lower suspension layer 16 so as to provide a soft upper suspension layer 18 and a firm lower suspension layer 16. The amount of flexure can generally be controlled by the choice of materials for the mesh suspension layers 16, 18 as well as the degrees of rotational freedom permitted by the u-shaped carriers 22, 24.

Advantageously, the mattress foundation 14 with the lower and upper mesh dual suspensions layers 16, 18, respectively, provides the mattress and foundation assembly 10 with improved airflow, optimal temperature management, counterbalanced comfort, and can be configured for any sized mattress. The assembly 10 provides independent and individualized support of a body thereon at any pressure point regardless of body size, shape, and body movement. Moreover, the mattress foundation assembly 10 permits easy access to and provides storage underneath the foundation 14. The mattress 12 of the mattress and foundation assembly 10 can be configured to be removable as will be described below and may also be configured to provide an appearance approximating that of a conventional mattress of the type typically disposed on a conventional box spring, for example. In this manner, the user can utilize traditional sheeting and supplemental bedding products such as a mattress topper pad as may be desired.

Figure 4:
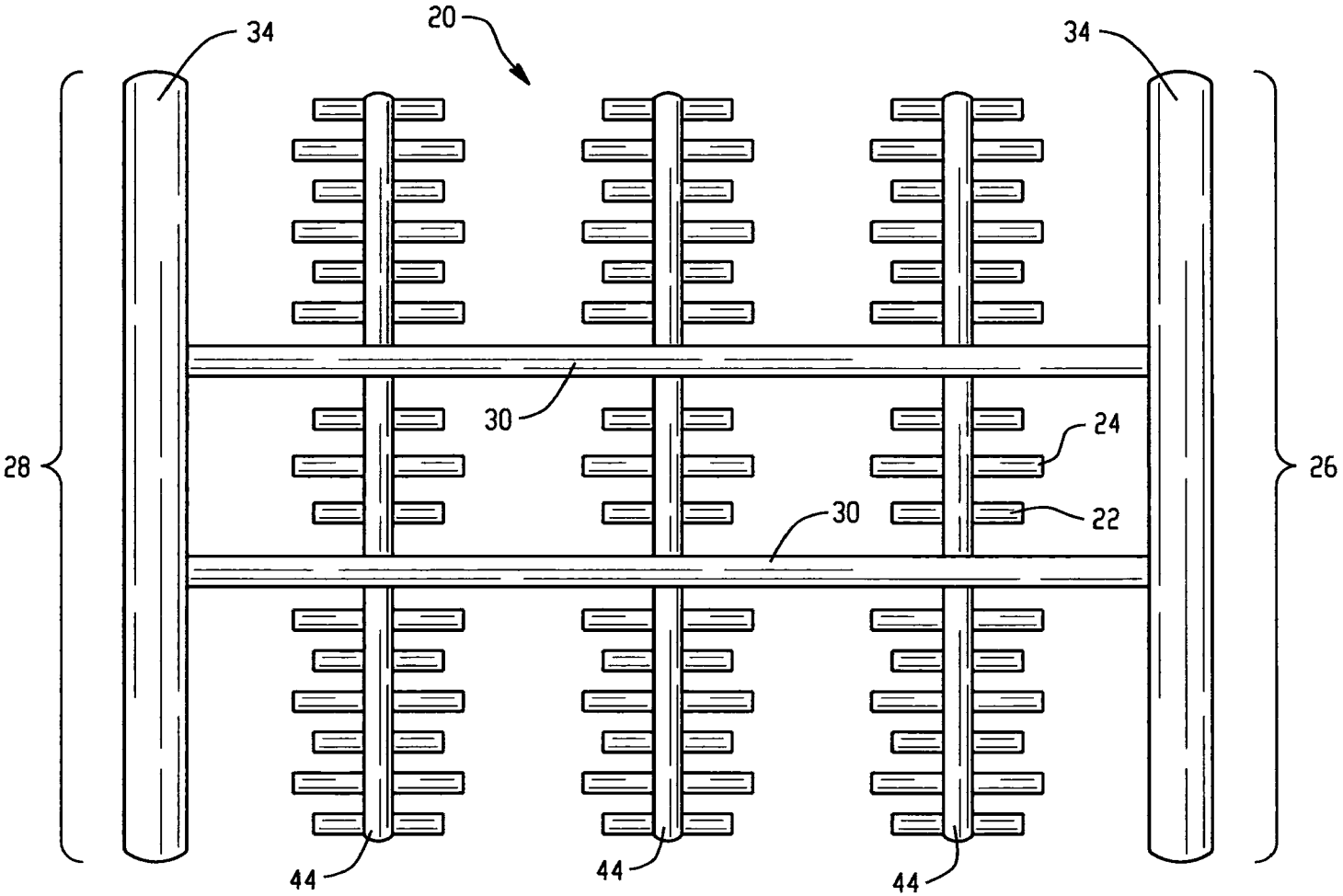
FIG. 4 is a top down plan view of the mattress foundation in accordance with the present disclosure.
Figure 5:
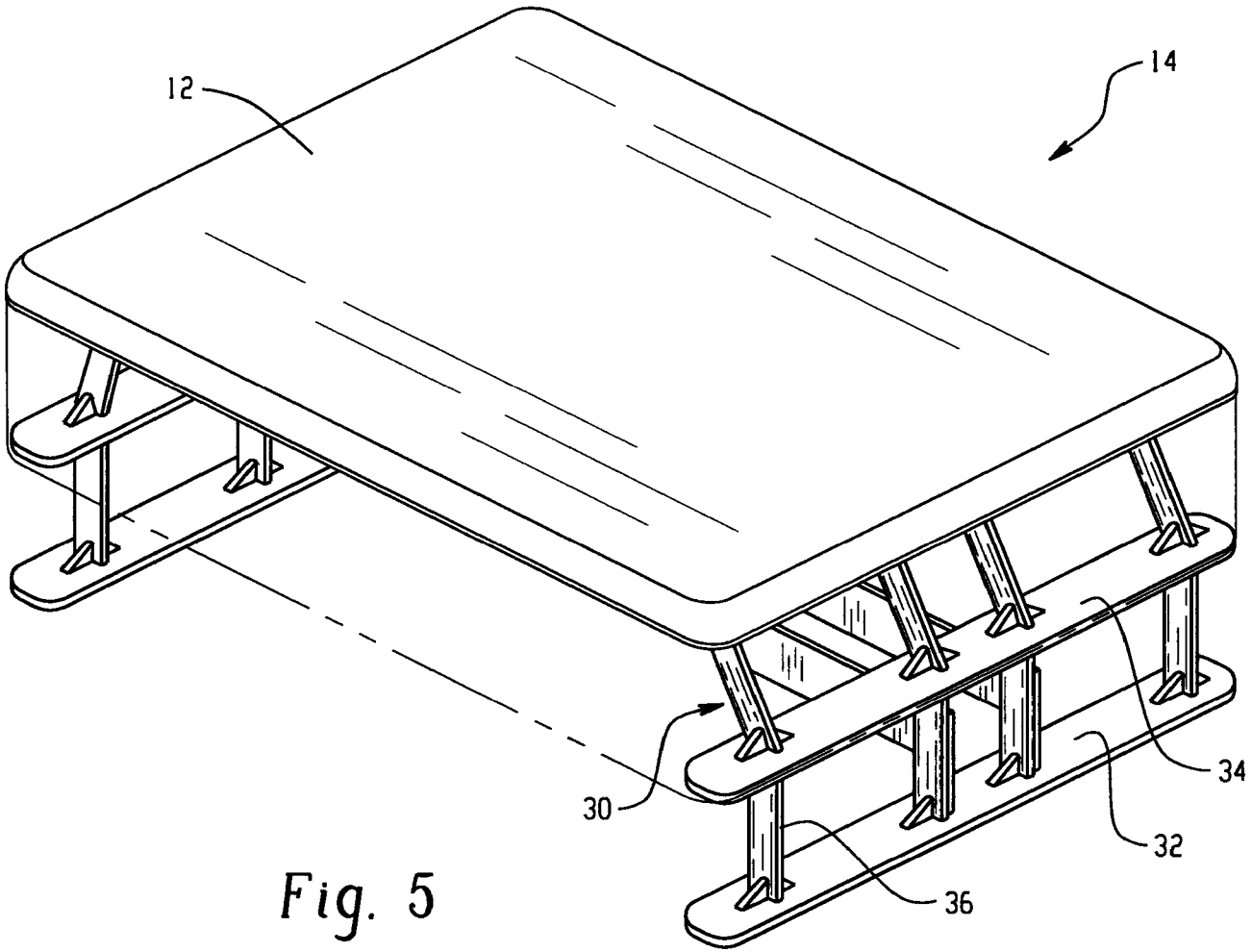
FIG. 5 is a silhouetted perspective view of the mattress foundation including a foam pad layer disposed on the upper suspension layer in accordance with the present disclosure.

As shown more clearly in FIG. 4, the mattress foundation frame 20 generally includes a head end 26, a foot end 28, and at least one transverse support member 30 there between, two of which are depicted. Although reference will now be made to the transverse members extending between the head and foot ends 26, 28, respectively, that generally correspond to the head and foot ends of a traditional mattress disposed thereon, it should be readily apparent that the frame could be oriented from side to side as opposed to from the depicted head end to foot end. However, maximum ease of underneath access is provided when the frame including the transverse members extends between the head and foot ends as is generally shown.

Each head and foot end 26, 28, respectively, generally includes an optional base 32 for contacting the ground, a top support 34 spaced apart from the base 32, and one or more vertical members 36 extending between the base 32 and the top support. 34. In some embodiments, the vertical members contact the ground directly and generally serve as leg supports for the top support 34. The height of the top support 34 can be configured to define the height at which the bottommost surface of the mattress 12 employed in the mattress foundation assembly 10 thereon is relative to ground. The transverse support members 30 are attached to and extend between the top supports 34 of the head and foot ends 26, 28. In one embodiment, the transverse support member 30 includes a vertically oriented portion 38 extending from the top support 34 and a substantially horizontal portion 40 extending there between such that the substantially horizontal portion is at a height greater than the top support (see FIG. 3).

The substantially horizontal portion 40 of the transverse member 30 includes a plurality of spaced apart openings 42, wherein the openings are configured to receive a rod inserted therein. In the event there is more than one transverse member such as the two shown, the openings of the multiple transverse support members 30 are coaxially aligned so as to permit a rod 44 to be inserted therein. In one embodiment, the openings 42 are spaced part about the horizontal portion of each transverse support members 30 at equal distances. In other embodiments, the openings 42 are spaced apart at unequal distances. The particular number and size of the openings are in amount and of a dimension that are effective to provide structural rigidity upon assembly of the mattress foundation assembly and provide sufficient support when used in combination with the u-shaped carriers 22, 24 and rods 44. Each rod 44 can be rotatably disposed within the coaxially aligned openings 42 between the transverse support members 30, wherein the u-shaped carriers 22, 24 are fixedly attached to the rods. Alternatively, the u-shaped carriers can be rotatably attached to the rods, wherein the rods are non-rotatably attached to the transverse support members 30. The number and location of the u-shaped carriers disposed on the rod can vary but should be provide sufficient support to both suspension layers 16, 18 and the mattress 12 of the mattress foundation assembly 10 when in use. The frame 20 may further include additional bracing materials and the like as may be desired for different applications.

Figure 6:
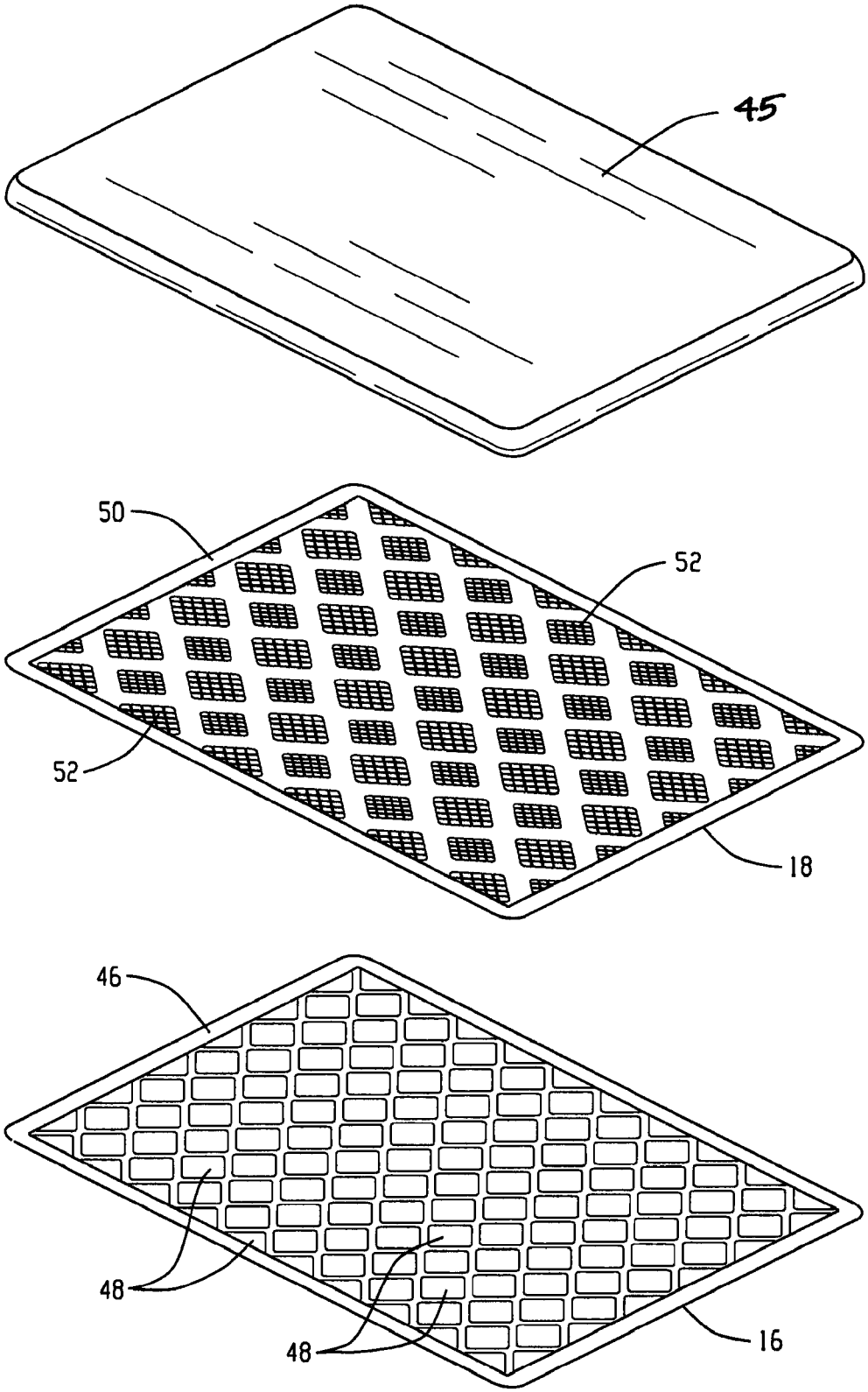
FIG. 6 is an exploded perspective view of the dual suspension layers including the foam pad layer of FIG. 5.

Referring now to FIG. 6, there is shown an exploded view of the lower and upper suspension layers 16, 18, respectively, and an optional foam padding layer 45 that may be disposed on the upper suspension layer 18. The lower suspension layer 16 includes a rigid frame 46 and a mesh 48 coextensive with the frame 46 defined by matrix having a plurality of openings. The mesh 48 is flexible as well as elastic and is held relatively taut within the frame 46. The particular pattern in the mesh 48 is generally not intended to be limited provided at least some of the openings 48 in the lower suspension layer 16 are of a dimension and at a location effective to permit a portion of the u-shaped carrier 24 to extend through the openings so as to contact and support the upper suspension layer 18. The lower suspension layer 16 is attached to and supported by the u-shaped carriers 22.

The upper suspension layer 18 includes a frame 50 and a mesh 52 coextensive with the frame 50 defined by matrix having a plurality of openings. The mesh 52 is flexible as well as elastic and is held relatively taut within the frame 50. Unlike the lower suspension layer 16, the upper suspension layer does not require openings to accommodate the u-shaped carriers and in some embodiments, it may be desirable to have a continuous sheet without any openings. However, it is generally desirable to have at least some openings to enable and control airflow and to provide temperature management. The upper suspension layer 16 is attached to and supported by the u-shaped carrier 24.

The terms "mesh" generally refers to a mesh material that is a continuous sheet in that it is essentially consistent in its composition of strands and intervening openings (although it may have a pattern therein) and essentially covers the entirety of the layer. The mesh material and frame may be of the same material or may be of a different material and is generally formed of a flexible and elastic material that readily deflects under the weight of a user upon pivot rotation of the u-shaped carrier and returns to its previous position after unloading (as opposed to an embossed metal or rigid screen, for example). By way of example only, the mesh material can be formed of an elastomer in whole or in part. The mesh may further include gels and phase change materials. For example, the mesh material can include a polypropylene mesh fabric or the like. The mesh can be a woven mesh or a knitted mesh. The openings in the mesh, which may have the same or different sizes based on the pattern of the weave, can have substantially the same size, dimension or width of the strands, or be on the same order provided that in the lower suspension layer 16 there are at least some openings of a size and dimension effective to permit the u-shaped carriers 24 to contact the upper suspension layer 18. Other types of mesh or compositions of strands with less or more elastomer can be used. As stated above, the mesh can be woven or knitted.

Alternatively, the mesh can be formed of flexible and elastic patterned open texture plastic. The term "sheet of patterned open texture plastic" is used herein to refer to a plastic material that has a series or arrangement of openings across the sheet and that is continuous within the frame. In addition, the sheet of plastic is flexible and elastic in that it readily deflects under the weight of a user and returns to its previous position after unloading (as opposed to an embossed metal or rigid screen). The sheet of plastic and the material of the sheet of plastic can be selected so that the sheet of plastic can deflect or bend. In addition, the openings can be sized and patterned to facilitate deflection or bending, and to eliminate pressure points. The openings and the material between the openings can be substantially the same size, dimension or width, or on the same order as was previously described for the elastomeric materials.

Figure 7:
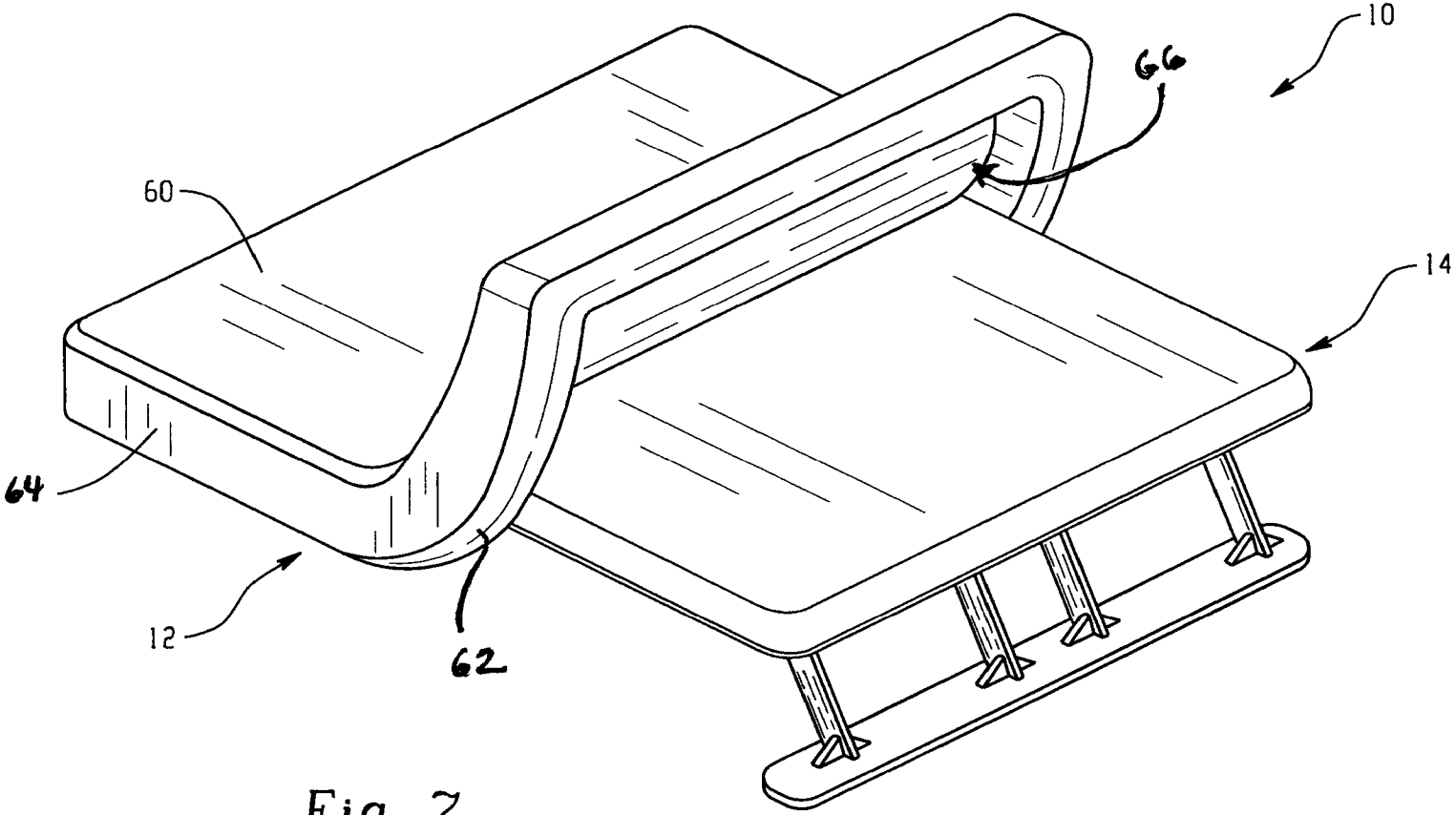
FIG. 7 is a perspective view of the mattress foundation assembly including the mattress having a recessed portion for placement onto the mattress foundation in accordance with the present disclosure.

Referring now to FIG. 7, there is shown the mattress 12 for the mattress foundation assembly, 10. The mattress is formed of at least one layer of a foam material and generally includes a planar top surface 60, a bottom surface 62, and sidewalls 64 extending between the top and bottom surfaces. The bottom surface 62 includes a recessed portion 66 dimensioned to snugly fit about the perimeters of the optional foam padding layer 45 and mesh dual suspension layers 16, 18 as shown. The depicted mattress may be covered with a casing of upholstery for providing a proper aesthetic appearance. By configuring the mattress with a recessed portion, weight is minimized, thereby reducing transportation costs. The mattress 12 can be removable and replaceable as can be optional foam padding layer 45.

Suitable foams include, but are not limited to, polyurethane foams including synthetic, blended and natural polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic materials are also temperature sensitive, thereby also enabling the convoluted foam layer to change shape based in part upon the temperature of the supported part. Any of these foams may be open celled or closed cell or a hybrid structure of open cell and closed cell. Likewise, the foams can be reticulated or partially reticulated or non-reticulated. The term reticulation generally refers to removal of cell membranes to create an open cell structure that is open to air and moisture flow. Still further, the foams may be gel infused in some embodiments, wherein gel is infused into at least some of the pores within the foam. In other embodiments, the foams can include phase change materials that are embedded or applied thereto. The different layers can be formed of the same material configured with different properties or be formed of different materials.

The various foams suitable for use in the mattress foundation assembly 10 may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well known Dunlap or Talalay processes.

The properties for the at least one foam layer defining the mattress 12 are not intended to be limited. For example, the hardness properties of foam are also referred to as the indention load deflection (ILD) or indention force deflection (IFD) and are measured in accordance with ASTM D-3574 and ASTM D-3575. By way of example, the hardness of the foam can have an indention load deflection (ILD) of about 7 to about 16 pounds force for viscoelastic foams and an ILD of about 7 to about 55 pounds force for non-viscoelastic foams. The density properties are a measurement of the mass per unit volume and can generally range from about 0.7 to about 2.5 pounds per cubic foot for non viscoelastic foams and about 1.5 to about 6 pounds per cubic foot for viscoelastic foams.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress and foundation assembly, comprising:
a mattress; and
a mattress foundation for supporting the mattress, the mattress foundation comprising:
a frame configured to elevate the mattress relative to ground; and
upper and lower flexible mesh suspension layers spaced apart from one another, each independently supported by a plurality of carriers at discrete points about the surface of the suspension layers, wherein the carriers are pivotably coupled to the frame.

2. The mattress and foundation assembly of claim 1, wherein the frame comprises a first base spaced apart from a second base and at least one transverse support member there between, wherein the transverse support member carries a plurality of rods perpendicular to the transverse support member, wherein the plurality of carriers are pivotably attached to the rods.

3. The mattress and foundation assembly of claim 1, further comprising at least one foam pad layer overlaying the upper suspension layer.

4. The mattress and foundation assembly of claim 1, wherein the mattress comprises a top planar surface and a bottom surface having a recessed portion dimensioned to snugly fit over the upper and lower suspension layers.

5. The mattress and foundation assembly of claim 2, wherein the carriers are u-shaped and pivot about an axis defined by the rods, and wherein each end of the u-shaped carriers are coupled to a selected one of the upper and lower layers.

6. The mattress and foundation assembly of claim 5, wherein the u-shaped carriers comprise a first set of u-shaped carriers configured to support the upper suspension layer and extend through openings in the lower suspension layer, and a second set of u-shaped carriers configured to support the lower suspension layer at a height below the upper suspension layer.

7. The mattress and foundation assembly of claim 1, wherein the mattress comprises foam.

8. The mattress and foundation assembly of claim 7, wherein the foam comprises multiple layers, wherein at least one of the layers is a viscoelastic foam.

9. The mattress and foundation assembly of claim 7, wherein the foam comprises multiple layers, wherein at least one of the layers is a non-viscoelastic foam.

10. The mattress and foundation assembly of claim 7, wherein the foam comprises polyurethane foams, latex foams including natural, blended and synthetic latex foams; polystyrene foams, polyethylene foams, polypropylene foam, or polyether-polyurethane foams.

11. The mattress and foundation of claim 10, wherein the polyurethane foams comprise synthetic polyurethane foams, blended polyurethane foams, or natural polyurethane foams.

12. The mattress and foundation assembly of claim 1, wherein the upper and lower flexible mesh suspension layers comprise an elastomer.

13. The mattress and foundation assembly of claim 1, wherein the upper and lower flexible mesh suspension layers each comprise a separate frame and a flexible mesh material coextensive with the frame.

14. The mattress and foundation assembly of claim 1, wherein the mattress comprises a non-viscoelastic foam having a hardness of about 7 to about 55 pounds·force and a density of 0.7 to about 2.5 pounds per cubic foot.

15. The mattress and foundation assembly of claim 1, wherein the mattress comprises a viscoelastic foam having a hardness of about 7 to about 16 pounds·force and a density of about 1.5 to about 6 pounds per cubic foot.

16. A mattress foundation for supporting the mattress, the mattress foundation comprising:

a frame configured to elevate the mattress relative to ground; and upper and lower flexible mesh suspension layers spaced apart from one another, each independently supported by a plurality of carriers at discrete points about the surface of the suspension layers, wherein the carriers are pivotably coupled to the frame.

17. The mattress foundation of claim 16, wherein the frame comprises a first base spaced apart from a second base and at least one transverse support member there between, wherein the transverse support member carries a plurality of rods perpendicular to the transverse support member, wherein the plurality of carriers are pivotably attached to the rods.

18. The mattress foundation of claim 16, further comprising at least one foam pad layer overlaying the upper suspension layer.

19. The mattress foundation of claim 17, wherein the carriers are u-shaped and pivot about an axis defined by the rods, and wherein each end of the u-shaped carriers are coupled at the discrete points of a selected one of the upper and lower suspension layers.

20. The mattress foundation of claim 19, wherein the u-shaped carriers comprise a first set of u-shaped carriers configured to support the upper suspension layer at a first height and extend through openings in the lower suspension layer, and a second set of u-shaped carriers configured to support the lower suspension layer at a second height below the upper suspension layer.

21. The mattress foundation of claim 16, wherein the upper and lower flexible mesh suspension layers comprise an elastomer.

22. The mattress foundation of claim 16, wherein the upper and lower flexible mesh suspension layers each comprise a separate frame and a flexible mesh material coextensive with the frame.

* * * * *